US009695524B2

(12) United States Patent
Kamachi

(10) Patent No.: US 9,695,524 B2
(45) Date of Patent: Jul. 4, 2017

(54) METHOD FOR REMOVING RARE EARTH IMPURITIES FROM NICKEL-ELECTROPLATING SOLUTION

(71) Applicant: HITACHI METALS, LTD., Minato-ku, Tokyo (JP)

(72) Inventor: Masanao Kamachi, Kumagaya (JP)

(73) Assignee: HITACHI METALS, LTD., Tokyo (JP)

( * ) Notice: Subject to any disclaimer, the term of this patent is extended or adjusted under 35 U.S.C. 154(b) by 495 days.

(21) Appl. No.: 14/346,058

(22) PCT Filed: Sep. 21, 2012

(86) PCT No.: PCT/JP2012/074151
§ 371 (c)(1),
(2) Date: Mar. 20, 2014

(87) PCT Pub. No.: WO2013/047340
PCT Pub. Date: Apr. 4, 2013

(65) Prior Publication Data

US 2014/0224664 A1 Aug. 14, 2014

(30) Foreign Application Priority Data

Sep. 28, 2011 (JP) ..... 2011-212339
Oct. 28, 2011 (JP) ..... 2011-237212

(51) Int. Cl.
*C25D 21/18* (2006.01)
*C25D 3/12* (2006.01)
(Continued)

(52) U.S. Cl.
CPC ..... *C25D 21/06* (2013.01); *C25D 3/12* (2013.01); *C25D 7/001* (2013.01); *C25D 21/18* (2013.01)

(58) Field of Classification Search
CPC .... C25D 21/18; C25D 3/12–3/18; B01D 1/24
See application file for complete search history.

(56) References Cited

U.S. PATENT DOCUMENTS 3,653,813 A 4/1972 Chiola et al.
5,037,463 A 8/1991 Engdahl et al.
(Continued)

FOREIGN PATENT DOCUMENTS

CN 101484615 A 7/2009
JP 61-533 A 1/1986
(Continued)

OTHER PUBLICATIONS

Nakayama and Sakamoto, english abstract and machine translation, JP 2006-77271 A (2006).*
(Continued)

*Primary Examiner* — James Lin
*Assistant Examiner* — Ho-Sung Chung
(74) *Attorney, Agent, or Firm* — Sughrue Mion, PLLC

(57) ABSTRACT

[Object] When rare earth magnets are plated, components of the rare earth magnets are dissolved in the plating solution, causing plating defects. Thus, an easy method for removing rare earth impurities has been necessary.

[Means for Solution] A nickel-electroplating solution containing rare earth impurities is kept at 60° C. or higher for a predetermined period of time to precipitate rare earth impurities for separation by sedimentation or filtration. Rare earth impurities can be precipitated further efficiently by adding precipitate to the nickel-electroplating solution, or by concentrating the nickel-electroplating solution by heating.

7 Claims, 4 Drawing Sheets

(51) Int. Cl.
*C25D 21/06* (2006.01)
*C25D 7/00* (2006.01)

(56) References Cited

U.S. PATENT DOCUMENTS

| | | | | |
|---|---|---|---|---|
| 2003/0226761 | A1* | 12/2003 | Featherstone | C22B 3/0016 205/539 |
| 2005/0232849 | A1* | 10/2005 | Shindo | C01G 3/10 423/557 |
| 2009/0078577 | A1 | 3/2009 | Suzuki et al. | |
| 2011/0120267 | A1* | 5/2011 | Roche | B01D 9/004 75/711 |
| 2012/0309614 | A1 | 12/2012 | Ohtake et al. | |
| 2016/0002814 | A1 | 1/2016 | Kamachi | |
| 2016/0002815 | A1 | 1/2016 | Kamachi | |

FOREIGN PATENT DOCUMENTS

| | | | | |
|---|---|---|---|---|
| JP | 02-209500 | A | 8/1990 | |
| JP | 2-209500 | A | 8/1990 | |
| JP | 7-34300 | A | 2/1995 | |
| JP | 07-062600 | A | 3/1995 | |
| JP | 7-62600 | A | 3/1995 | |
| JP | 2002-194600 | A | 7/2002 | |
| JP | 2006-77271 | A * | 3/2006 | C25D 21/18 |
| JP | 2006-077271 | A | 3/2006 | |
| JP | 2008-45187 | A | 2/2008 | |
| JP | 2013-173993 | A | 9/2013 | |

OTHER PUBLICATIONS

Li et al., Recovery of Ni, Co and rare earths from spent Ni-metal hydride batteries and preparation of spherical Ni(OH)2, 100 Hydrometallurgy 41-46 (2009).*
Communication dated Sep. 6, 2015 from the State Intellectual Property Office of the P.R.C. in counterpart application No. 201280048690.7.
Chinese Office Action issued Dec. 1, 2016, for Application No. 201480017674.0, 13 pages total.
Non-Final Office Action dated Oct. 19, 2016, issued in U.S. Appl. No. 14/771,330, 8 pages.
International Search Report for International Application No. PCT/JP2014/057107 dated Jun. 17, 2014; 4 pages.
International Search Report for International Application No. PCT/JP2014/057136 dated Jun. 17, 2014; 5 pages.
Chinese Office Action issued Dec. 1, 2016, for Application No. 201480017713.7, 13 pages total.
Final Office Action dated Feb. 15, 2017, issued in corresponding U.S. Appl. No. 14/771,330, 11 pages.
An Office Action dated Mar. 24, 2017, which issued during the prosecution of U.S. Appl. No. 14/771,327.

* cited by examiner

METHOD FOR REMOVING RARE EARTH IMPURITIES FROM NICKEL-ELECTROPLATING SOLUTION

CROSS REFERENCE TO RELATED APPLICATIONS

This application is a National Stage of International Application No. PCT/JP2012/074151, filed on Sep. 21, 2012 (which claims priority from Japanese Patent Application Nos. 2011-212339, filed on Sep. 28, 2011, and 2011-237212, filed Oct. 28, 2011), the contents of which are incorporated herein by reference in their entirety.

FIELD OF THE INVENTION

The present invention relates to a method for removing rare earth impurities from a nickel-electroplating solution efficiently and easily.

BACKGROUND OF THE INVENTION

Among rare earth magnets, particularly sintered R—Fe—B magnets, wherein R is at least one of rare earth elements including Y, Nd being indispensable, have high magnetic properties with wide applications. However, Nd and Fe contained therein as main components are extremely vulnerable to rusting. Accordingly, to have improved corrosion resistance, the magnets are provided with anti-corrosive coatings. Among them, nickel electroplating provides high-hardness coatings with easier plating steps than electroless plating, so that it is widely used for these magnets.

In an early growing stage of an electroplated nickel layer, components in articles to be plated are likely dissolved into a plating solution. Particularly when a plating solution is too acidic, or when articles to be plated are easily soluble in a plating solution, the articles are dissolved in the plating solution, with impurities accumulated. In the case of the sintered R—Fe—B magnets, rare earth elements such as Nd, etc. and Fe, main components, are dissolved in a plating solution, forming impurities.

Accordingly, rare earth elements such as Nd, etc. and Fe, main components of the magnet, are dissolved and accumulated in the plating solution by continuous plating. To carry out plating without impurities, a new plating solution should be prepared for every plating. In the production process, the preparation of a new plating solution for every plating suffers cost increase, substantially impossible.

In the case of nickel electroplating, the presence of impurities in the plating solution generally tends to cause poor gloss, insufficient adhesion to an article to be plated, burnt deposits, etc. For example, when rare earth elements in amounts more than certain levels are accumulated as impurities in the plating solution, a plating layer has decreased adhesion to a magnet or peels therefrom, or double plating (interlayer peeling) occurs due to current interruption during a plating process. The generation of defects such as double plating due to decreased adhesion depends on the plating solution composition and plating conditions, and the inventors' experiment has revealed that when the amount of rare earth impurities (mainly Nd) exceeds 700 ppm, such defects tend to occur. It has further been confirmed that in barrel-type plating, large current tends to locally flow in an article to be plated, causing double plating.

When nickel electroplating is conducted in an industrial mass production scale, it is unpractical from the aspect of production cost to keep a nickel-electroplating solution completely free from rare earth impurities, and so it is not generally used. However, it is preferable from the aspect of quality control to keep the amount of rare earth impurities as low as not exceeding 700 ppm.

Generally used to remove impurities such as Fe, etc. dissolved in a nickel-electroplating solution are a method of adding a nickel compound such as nickel carbonate, etc. to a plating solution to elevate the pH of the plating solution (simultaneously activated carbon may be added to remove organic impurities), and conducting air stirring to precipitate impurities, and then filtering them out; and a method of immersing an iron net or plate in a plating solution, and conducting cathodic electrolysis at a low current density. Though these methods are effective to remove iron and organic impurities dissolved in a nickel-electroplating solution, they have extreme difficulty to remove rare earth impurities.

Patent Reference 1 discloses a method for removing rare earth impurities from a nickel-electroplating solution by using an agent for the purifying or separating rare earth metals. This method appears to be effective to reduce the amounts of rare earth impurities in a nickel-electroplating solution. However, this method is not only inefficient because of complicated steps, but also it needs special agents.

PRIOR ART REFERENCE

Patent Reference 1: JP 7-62600 A.

OBJECT OF THE INVENTION

Accordingly, an object of the present invention is to provide a method for removing rare earth impurities from a nickel-electroplating solution relatively easily and efficiently, without needing complicated steps and special agents.

DISCLOSURE OF THE INVENTION

The present invention recited in claim 1 is directed to a method for removing rare earth impurities from a nickel-electroplating solution, which comprises the steps of keeping a nickel-electroplating solution containing rare earth impurities at a temperature of 60° C. or higher for a predetermined period of time, and then removing precipitate generated by heating from the nickel-electroplating solution by sedimentation and/or filtration.

The present invention recited in claim 2 is directed to the method recited in claim 1 for removing rare earth impurities from a nickel-electroplating solution, wherein the nickel-electroplating solution is stirred during heating.

The present invention recited in claim 3 is directed to the method recited in claim 2 for removing rare earth impurities from a nickel-electroplating solution, wherein the stirring is conducted by air stirring, the rotation of a stirring blade or circulation by a pump.

The present invention recited in claim 4 is directed to a method in which the operation recited in claim 1 for removing rare earth impurities from a nickel-electroplating solution is repeated plural times, the nickel-electroplating solution being heated with precipitate generated by the previous operation existing.

The term "existing" means, as indicated by Examples below, a case where precipitate is added to a nickel-electroplating solution, or a case where a plating solution is added to a bath in which precipitate remains, as long as precipitate exists in the nickel-electroplating solution.

The present invention recited in claim 5 is directed to the method recited in any one of claims 1-4 for removing rare earth impurities from a nickel-electroplating solution, wherein the nickel-electroplating solution is concentrated by heating.

The present invention recited in claim 6 is directed to the method recited in claim 5 for removing rare earth impurities from a nickel-electroplating solution, wherein the nickel-electroplating solution is concentrated up to 3 times.

The present invention recited in claim 7 is directed to a method for producing a sintered rare earth magnet having a plating layer, comprising the steps of preparing a nickel-electroplating solution containing rare earth impurities, keeping the plating solution at 60° C. or higher for a predetermined period of time, removing precipitate by sedimentation and/or filtration from the nickel-electroplating solution heated for a predetermined period of time, and electroplating the sintered rare earth magnet with nickel in the precipitate-removed nickel-electroplating solution.

DESCRIPTION OF THE PREFERRED EMBODIMENTS

Figure 1:
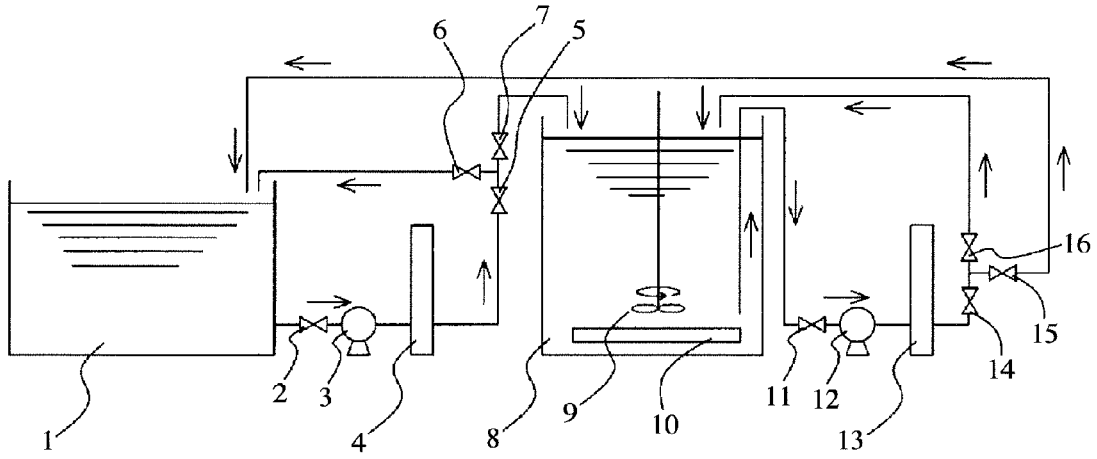
FIG. 1 is a schematic view showing an example of nickel-electroplating apparatuses for carrying out the method of the present invention for removing rare earth impurities from a nickel-electroplating solution.

The method of the present invention for removing rare earth impurities from a nickel-electroplating solution comprises the steps of keeping a nickel-electroplating solution containing rare earth impurities at a temperature of 60° C. or higher for a predetermined period of time, and then removing precipitate generated by heating from the nickel-electroplating solution by sedimentation and/or filtration.

In the present invention, for example, when a sintered R—Fe—B magnet, wherein R is at least one of rare earth elements including Y, Nd being indispensable, is electroplated with nickel, rare earth impurities are R components dissolved in the plating solution, most of which exist in the form of ions in the plating solution, so that they are difficult to collect by filtration without treatment. The present invention turns rare earth impurities existing in the form of ions to solid precipitate collectable by a filter means, so that the precipitate can be removed from the plating solution by sedimentation or filtration. It should be noted that the present invention is not restricted to the removal of R components dissolved in the plating solution when the sintered R—Fe—B magnet is electroplated with nickel, but applicable to the removal of rare earth impurities existing in the form of ions in the plating solution.

The solution temperature when the rare earth impurities are removed should be 60° C. or higher. At lower than 60° C., the removal of rare earth impurities takes a lot of time, not suitable for industrial production. A higher solution temperature tends to increase the efficiency of removing rare earth impurities, and its upper limit is not necessarily limited. From the aspect of operability and safety, and influence on the plating solution composition, etc., however, the temperature of the plating solution is preferably lower than the boiling point. When the plating solution is heated to the boiling point or higher, water is rapidly evaporated from the plating solution, resulting in rapid precipitation of components constituting the plating solution. Though the boiling point of the plating solution varies depending on its composition, the boiling point of a Watts bath, for example, is about 102° C.

Because the boiling point of the plating solution is elevated as the molar elevation of the boiling point increases, the removal of impurities from plating solutions with different compositions can be controlled with the upper limit of the boiling point as 100° C., the boiling point of water. Thus, heating is preferably in a range from 60° C. to 100° C., further preferably in a range from 80° C. to 95° C., more preferably 80° C. to 90° C., in the present invention.

A bath used for carrying out the method of the present invention for removing rare earth impurities should have high heat resistance in the above heating range (the temperature of the heated plating solution). Accordingly, as this temperature is elevated, its cost inevitably increases. Operation in the above temperature range, particularly in the desired temperature range, results in the suppression of cost increase.

The concentration of the plating solution from which impurities are removed is preferably 1-3 times a concentration range in which plating is conducted. The plating solution is concentrated preferably by heating. Concentration occurs when heated, because water, a solvent, is evaporated by heating the plating solution. When the plating solution is concentrated by heating, a higher temperature in the desired heating temperature range of the present invention results in a shorter period of time necessary for concentrating the plating solution.

When the concentration of the plating solution exceeds 3 times by heating, components in the plating solution are undesirably precipitated rapidly. The plating solution is more preferably concentrated to a range of 1-2 times. Though operation is possible in a range of 2-3 times, the concentration near 3 times makes it necessary to carefully control the operation, such that components in the plating solution are not precipitated. Because heating reduces the amount of the plating solution by the evaporation of water, water is supplied to keep the amount of the plating solution constant. For example, when a heater is exposed from a solution surface lowering by the concentration of the plating solution, the heater may be broken. In such a case, water is preferably supplied to keep the concentration constant. Also, if the concentration of the plating solution is kept constant, the adjustment of the concentration by supplying water can be conducted in a short period of time, when the impurities-removed plating solution is returned from a preliminary bath used for removing impurities to a plating bath.

The present invention is suitable for the removal of rare earth impurities in an acidic to neutral nickel-plating solution. The nickel-plating solution may be a Watts bath, a high-chloride bath, a chloride bath, a sulfamate bath, etc. The present invention is most suitable for a Watts bath. The composition of the Watts bath may be a general one. For example, the present invention is applicable to a composition comprising 200-320 g/L of nickel sulfate, 40-50 g/L of nickel chloride, 30-45 g/L of boric acid, and a glossing agent and a pit-preventing agent as additives. The adjustment of the plating solution composition may be conducted by a known analysis method (titration analysis, etc.). For example, in the case of a Watts bath, nickel chloride and nickel sulfate are first analyzed by the titration of nickel, and boric acid is then analyzed by titration.

In the present invention, nickel sulfate, nickel chloride and boric acid need not be add if the plating solution composition is within a predetermined range after the removal of rare earth impurities, but if they are insufficient, they are added to the plating solution in amounts necessary for adjusting its composition. When added, they are preferably heated to the plating temperature. If they were added at low temperatures, they would be slowly dissolved or not dissolved. After the composition adjustment, the pH of the plating solution is adjusted by nickel carbonate or sulfuric acid, and plating is conducted with known glossing agent and pit-preventing agent added. Plating conditions using the plating solution according to the present invention may be properly changed, depending on an apparatus used, a plating method, the size and number of articles to be plated, etc. For example, when a plating bath having the above Watts bath composition is used, the plating conditions are preferably pH of 3.8-4.5, a bath temperature of 45-55° C., and a current density of 0.1-10 A/dm$^2$. The plating method including a rack-type and a barrel-type may be properly selected depending on the size and amount of articles to be plated.

In the present invention, impurities can be removed from the nickel-electroplating solution only with a plating bath, without needing a preliminary bath for removing impurities, when the plating bath is constituted by a heat-resistant FRP or PP or a fluororesin-coated iron plate. However, with a plating bath made of polyvinyl chloride (PVC) and a preliminary bath made of heat-resistant material, impurities can be removed in the preliminary bath, and plating can be conducted in the plating bath, resulting in higher efficiency and improved operability. Higher safety is achieved by making both plating bath and preliminary bath by a heat-resistant material.

A structure comprising the plating bath and the preliminary bath for removing rare earth impurities will be explained below referring to FIG. 1. In the figure, 1 represents a plating bath comprising an anode, a cathode, a heater, and a stirrer, which are not shown, to carry out nickel electroplating in a plating solution. Materials for the plating bath are preferably polyvinyl chloride (PVC) or heat-resistant polyvinyl chloride (PVC), though changeable depending on the plating solution used.

In the figure, 2, 5, 6 and 7 represent valves, 3 represents a pump, and 4 represents a filter means. The filter means may comprise a known filter for electroplating. The filter means 4 may be integral with the pump 3. Pipes are preferably made of polyvinyl chloride (PVC) or heat-resistant polyvinyl chloride (PVC).

With the valve 7 closed and the valves 2, 5 and 6 open, the pump 3 is operated to circulate a plating solution in the plating bath 1 to the filter means 4 for filtration. Namely, the plating solution is circulated for filtration through a path of plating bath 1→valve 2→pump 3→filter means 4→valve 5→valve 6→plating bath 1.

In the figure, 8 represents a preliminary bath, which comprises a stirring blade 9 connected to a motor (not shown), and a heater 10 connected to a power source (not shown). The preliminary bath 8 is preferably made of heat-resistant PP or FRP, to treat a high-temperature plating solution containing rare earth impurities.

In the figure, 11, 14, 15 and 16 represent valves, 12 represents a pump, and 13 represents a filter means. The filter means 13 may be integral with the pump 12. The heater 10 disposed in the above preliminary bath 8 may be a vapor heater connected to a vapor-generating apparatus through a pipe. The plating solution containing rare earth impurities may be stirred using an aeration pipe connected to an air pump, in place of the stirring blade 9 depicted. The plating solution can also be stirred in the preliminary bath by circulation with the pump 12 described later.

The circulation of the plating solution in the preliminary bath and the sending of the plating solution between the preliminary bath and the plating bath will be explained below. With the valve 6 closed and the valves 2, 5 and 7 open, the pump 3 is operated to send the plating solution in the plating bath 1 to the preliminary bath 8 through the filter means 4. Namely, the plating solution flows through a path of plating bath 1→valve 2→pump 3→filter means 4→valve 5→valve 7→preliminary bath 8.

With the valve 15 closed and the valves 11, 14 and 16 open, the pump 12 is operated to circulate the plating solution in the preliminary bath 8 via the filter means 13 for filtration. Namely, the plating solution is circulated for filtration through a path of preliminary bath 8→valve 11→pump 12→filter means 13→valve 14→valve 16→preliminary bath 8.

With the valve 16 closed and the valves 11, 14 and 15 open, the pump 12 is operated to send the plating solution in the preliminary bath 8 to the plating bath 1 via the filter means 13. Namely, the plating solution flows through a path of preliminary bath 8→valve 11→pump 12→filter means 13→valve 14→valve 15→plating bath 1.

Rare earth impurities precipitated by heating in the preliminary bath 8 shown in FIG. 1 are sedimented at a bottom of the preliminary bath 8, when stirring with the blade 9 is stopped. When the plating solution is circulated from the preliminary bath 8 to the plating bath 1 through a path of preliminary bath 8→valve 11→pump 12→filter means 13→valve 14→valve 15→plating bath 1 after the sedimentation of precipitate, the clogging of the filter with precipitate can be prevented, making it possible to use a filter in the filter means 13 for a long period of time.

Because a tip end (sucking the plating solution) of the pipe connecting the preliminary bath 8 to the pump 12 via the valve 11 is not in contact with a bottom of the preliminary bath 8, precipitate accumulated on the bottom are not sucked. The plating solution subject to precipitation by heating may be quickly sent to the plating bath 1 before sedimentation. When the plating solution from which precipitate is sedimented is sent from the preliminary bath 8 to the plating bath 1, the filter means 13 may not comprise a filter. With precipitate sedimented on the bottom of the preliminary bath 8, the plating solution sent from the preliminary bath 8 to the plating bath 1 contains an extremely small amount of precipitate. Accordingly, precipitate remaining in the plating solution sent to the plating bath 1 can be removed by filtration (plating bath 1→valve 2→pump 3→filter means 4→valve 5→valve 6→plating bath 1).

The present invention can be conducted not only with the above apparatus, but also with apparatuses having various structures. For example, a pipe for the circulation of the plating solution in the plating bath 1 may be completely separate from a pipe for the circulation of the plating solution in the plating bath 1 to the preliminary bath 8. Specific structures will be explained with the valves, the pump, the filter means and the pipes connected to the plating bath 1.

As described above, when the pump 3 is operated with the valve 7 closed and the valves 2, 5 and 6 open, the plating solution is circulated through a path of plating bath 1→valve 2→pump 3→filter means 4→valve 5→valve 6→plating bath 1. Also, when the pump 3 is operated with the valve 6 closed and the valves 2, 5 and 7 open, the plating solution is sent through a path of plating bath 1→valve 2→pump 3→filter means 4→valve 5→valve 7→bath 8. Circulation in the plating bath 1 and sending from the plating bath 1 to the preliminary bath 8 are thus switched by operating the valves 5, 6 and 7. In this case, a path of valve 2→pump 3→filter means 4→valve 5 are commonly used in both circulations. With the above common portion separated, a circulation pipe is connected to valve 2→pump 3→filter means 4→valve 5→valve 6→plating bath 1 (valves 5 and 6 are not necessarily indispensable), and another pipe is connected to valve 2' →pump 3' →filter means 4' →valve 5' →valve 7→preliminary bath 8 (valves 5' and 7 are not necessarily indispensable). With such structure, paths are simple, avoiding the maloperation of valves, etc. In the circulation pipe in the preliminary bath 8 and the solution-sending pipe between the preliminary bath 8 and the plating bath 1, too, a common portion may be separated to achieve the same effects as described above.

Figure 2:
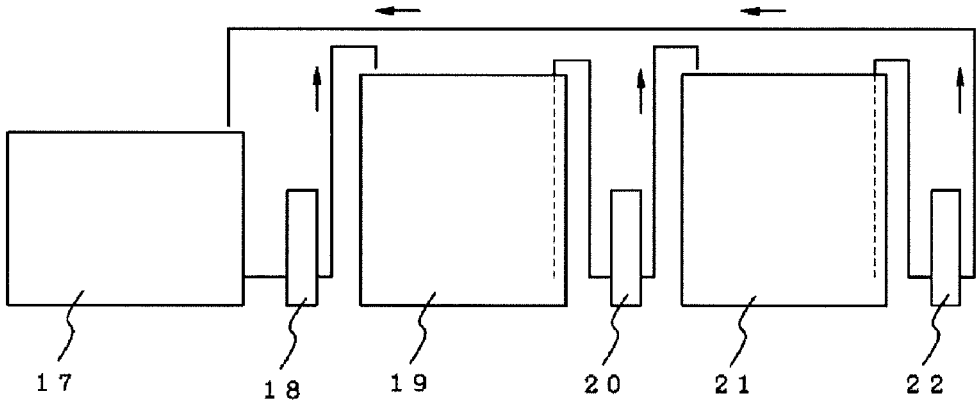
FIG. 2 is a schematic view showing another example of nickel-electroplating apparatuses for carrying out the method of the present invention for removing rare earth impurities from a nickel-electroplating solution.

FIG. 2 shows another structure of the apparatus for carrying out the present invention, which comprises another preliminary bath in addition to the plating bath and the preliminary bath shown in FIG. 1. Because explanations referring to FIG. 2 are mainly directed to the functions of the plating bath and the preliminary bath, a heater and a stirring blade disposed in each preliminary bath, and electrodes, etc. disposed in the plating bath are not depicted. Valves and circulation pipes in and between the preliminary bath and the plating bath are also not depicted, with only pipes necessary for sending the plating solution depicted.

In the figure, 17 represents a plating bath, 19 represents a first preliminary bath, 21 represents a second preliminary bath, and 18, 20 and 22 represent integrated pump and filter means. With such structure, after a plating solution containing rare earth impurities is sent to the first preliminary bath 19, a plating solution stored in the second preliminary bath 21, in which the concentrations of rare earth impurities are zero or reduced to predetermined levels, is sent to the plating bath 17, resulting in a shorter time period of interrupting plating operation in the plating bath 17.

Alternatively, rare earth impurities can be removed by multi stages; for example, rare earth impurities can be removed in an amount up to half of the target from the plating solution in the first preliminary bath 19, and then in a remaining amount of the target from the plating solution sent to the second preliminary bath 21. Thus, the amounts of rare earth impurities removed can be set depending on the capacity of each preliminary bath 19, 21, resulting in improved practicality in an industrial scale.

Example 1

A plating solution of pH 4.5 having a composition comprising 250 g/L of nickel sulfate, 50 g/L of nickel chloride and 45 g/L of boric acid was heated at 50° C., to carry out nickel electroplating on various types of sintered R—Fe—B magnets in a composition range comprising 15-25% by mass of Nd, 4-7% by mass of Pr, 0-10% by mass of Dy, 0.6-1.8% by mass of B, 0.07-1.2% by mass of Al, and 3% or less by mass of Cu and Ga, the balance being Fe, depending on necessary magnetic properties. In each batch, magnets having the same composition were used. The composition and amount of rare earth impurities dissolved in the plating solution differ depending on magnets to be plated, a plating method such as a barrel type or a rack type, and the composition of the plating solution.

After plating for several days, the impurities of Nd, Pr and Dy in the nickel-electroplating solution were analyzed by an ICP atomic emission spectrometer. The analysis results were 500 ppm of Nd, 179 ppm of Pr, and 29 ppm of Dy.

A predetermined amount (3 liters) of the plating solution containing the above rare earth impurities was introduced into a beaker, and kept at 90° C. by a heater for a predetermined period of time. Stirring was conducted by a magnet-type stirrer during heating. During heating, water was supplied such that the concentration of the plating solution was kept constant.

After 24 hours and 96 hours, respectively, the plating solution in a sufficient amount for ICP atomic emission spectrometry was collected and filtered by a filter paper. The concentrations of Nd, Pr and Dy in the filtered plating solution were measured by an ICP atomic emission spectrometer. The analysis results were 100 ppm of Nd, 35 ppm of Pr, and 16 ppm of Dy after 24 hours, and 50 ppm of Nd, 16 ppm of Pr, and 2 ppm of Dy after 96 hours.

As described above, rare earth impurities dissolved in the form of ions in the nickel-electroplating solution are precipitated by heating for a predetermined period of time, and separated and removed from the plating solution by filtration. Rare earth impurities not precipitated by heating for a predetermined period of time remain in the form of ions in such amounts as shown by the above analysis results in the plating solution. The above analysis indicates that the longer the heating time, the more rare earth impurities are separated and removed as precipitate. As a result, the amounts of rare earth impurities in the form of ions are reduced in the plating solution. It was confirmed that the method of Example 1 reduced not only the amount of Nd but also the amounts of Pr and Dy, as rare earth impurities.

Example 2

A plating solution of pH 4.5 having a composition comprising 250 g/L of nickel sulfate, 50 g/L of nickel chloride, and 45 g/L of boric acid was heated to 50° C. to carry out nickel electroplating on sintered R—Fe—B magnets having the same composition range as in Example 1. After plating for several days, analysis revealed that the amount of Nd, an impurity, in the nickel-electroplating solution was 576 ppm.

Figure 3:
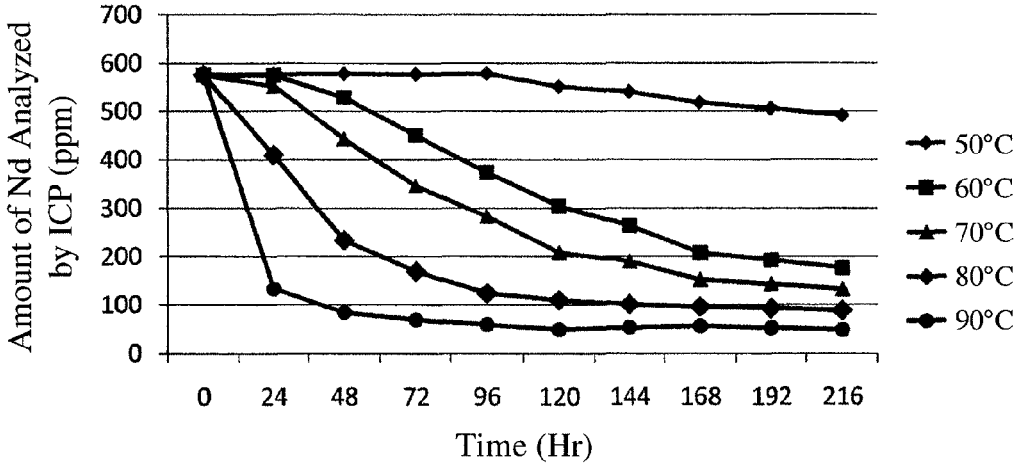
FIG. 3 is a graph showing the amount of Nd as a rare earth impurity in the filtered plating solution with the temperature changed, which was analyzed by an ICP atomic emission spectrometer.

The above plating solution each 3 liters was introduced into beakers and heated at a temperature increasing from 50° C. to 95° C. by 6 steps (5 steps elevating every 10° C. between 50° C. and 90° C.). During heating, stirring was conducted by a magnet stirrer. During heating, water was supplied such that the concentration of the plating solution was kept constant, and the plating solution in a sufficient amount for ICP atomic emission spectrometry was taken at constant intervals, filtered, and then analyzed with respect to the amount (concentration) of Nd, an impurity, by an ICP atomic emission spectrometer. The analysis results are shown in Table 1 and in the graph of FIG. 3 (between 50° C. and 90° C.).

TABLE 1

| | 0 hrs | 24 hrs | 48 hrs | 72 hrs | 96 hrs | 120 hrs | 144 hrs | 168 hrs | 192 hrs | 216 hrs |
|---|---|---|---|---|---|---|---|---|---|---|
| 50° C. | 576 | 578 | 579 | 578 | 579 | 552 | 541 | 518 | 506 | 491 |
| 60° C. | 576 | 575 | 529 | 450 | 374 | 305 | 265 | 208 | 193 | 177 |
| 70° C. | 576 | 553 | 443 | 346 | 284 | 209 | 190 | 153 | 144 | 133 |
| 80° C. | 576 | 410 | 234 | 170 | 125 | 110 | 101 | 96 | 93 | 88 |
| 90° C. | 576 | 134 | 84 | 69 | 59 | 49 | 53 | 56 | 52 | 48 |
| 95° C. | 576 | 130 | — | — | 52 | — | — | — | — | — |

Note:
The unit was ppm.

At a heating temperature of 50° C., the impurity concentration was 518 ppm after 168 hours. At 60° C., the impurity concentration was reduced after 24 hours, and reached 177 ppm when 216 hours passed. The impurity concentration was always lower at 70° C. than at 60° C. after 24 hours. At a heating temperature of 80° C., the impurity concentration was reduced immediately after heating, and reached 125 ppm when 96 hours passed. At a heating temperature of 90° C., it was 134 ppm when 24 hours passed, 84 ppm when 48 hours passed, and 59 ppm when 96 hours passed. At a heating temperature of 95° C., the amount of the Nd, an impurity, was analyzed after 24 hours and 96 hours, indicating that it was substantially the same as when heated at 90° C.

Example 3

The plating solution heated in Examples 1 and 2 was filtered by a filter paper to collect precipitate. The precipitate was dried in a thermostatic chamber. The dried precipitate was in the form of powder (solid). Analysis by an energy-dispersive X-ray spectrometer (EDX) revealed that the precipitate comprised by mass 32.532% of Nd, 11.967% of Pr, 1.581% of Dy, 0.402% of Al, 7.986% of Ni, 0.319% of C, and 45.213% of 0. It was confirmed that rare earth impurities were precipitated in the form of powder (solid) from the plating solution by heating.

Example 4

1 g/L of the above precipitate was added to the same plating solution containing rare earth impurities (the concentration of Nd: 576 ppm) as in Example 2. 3-liter portions of the precipitate-added plating solution were introduced into beakers, and heated at 60° C. and 70° C., respectively. During heating, stirring was conducted as in Examples 1 and 2. 3-liter portions of the plating solution to which the above precipitate was not added were also introduced into beakers, and heated 60° C. and 70° C., respectively. Regardless of whether the above precipitate was added or not, water was supplied during heating such that the concentration of the plating solution was kept constant.

Figure 4:
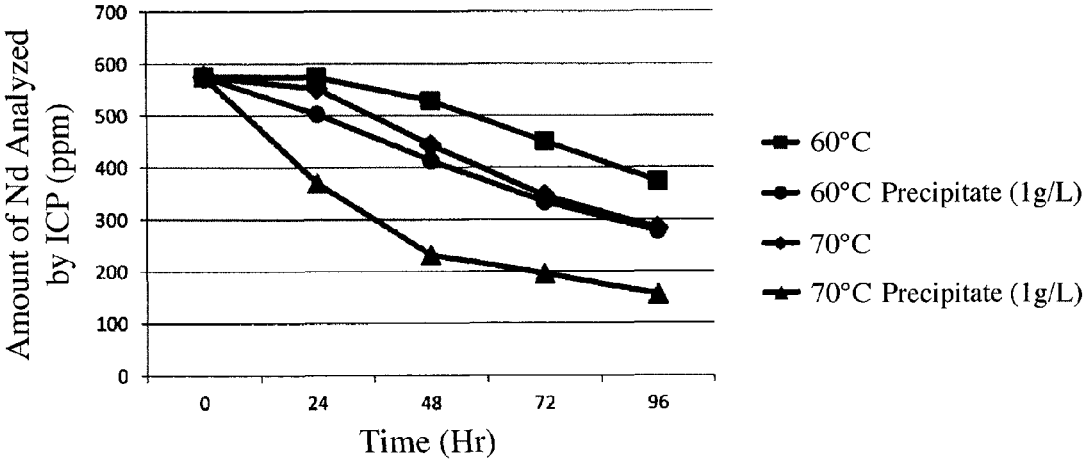
FIG. 4 is a graph showing the amount of Nd as a rare earth impurity in the filtered plating solution with the rare earth impurity (precipitate) added to the plating solution, which was analyzed by an ICP atomic emission spectrometer.

The plating solution was taken in a sufficient amount for ICP atomic emission spectrometry at constant intervals, and the concentration of Nd, an impurity, in the plating solution was measured by an ICP atomic emission spectrometer in the same manner as in Example 1. The results are shown in Table 2 as well as in the graph of FIG. 4. At both heating temperatures of 60° C. and 70° C., the Nd impurity decreased more in the above precipitate-added plating solution than in the plating solution with no precipitate added in the same period of time.

TABLE 2

| | 0 hrs | 24 hrs | 48 hrs | 72 hrs | 96 hrs |
|---|---|---|---|---|---|
| 60° C. | 576 | 575 | 529 | 450 | 374 |
| 60° C. (Precipitate: 1 g/L) | 576 | 503 | 413 | 334 | 279 |
| 70° C. | 576 | 553 | 443 | 346 | 284 |
| 70° C. (Precipitate: 1 g/L) | 576 | 370 | 233 | 196 | 157 |

Note:
The unit was ppm.

Example 5

A plating solution of pH 4.5 having a composition comprising 250 g/L of nickel sulfate, 50 g/L of nickel chloride, and 45 g/L of boric acid was heated at 50° C., to carry out nickel electroplating on several types of sintered R—Fe—B magnets in the same composition range as in Example 1. After plating for several days, analysis by an ICP atomic emission spectrometer revealed that the Nd impurity in the nickel-electroplating solution was 544 ppm.

3-liter portions of the above plating solution were introduced into two beakers and heated to 90° C. In one beaker, water was added last that the concentration of the plating solution was changed (the amount of the solution was reduced) during heating. In the other beaker, water was not added until the concentration of the plating solution became 2 times (the amount of the solution became half) by heating, and water was added to keep the amount of the solution when the amount of the solution reached half. In both cases, stirring was conducted as in Example 1.

Figure 5:
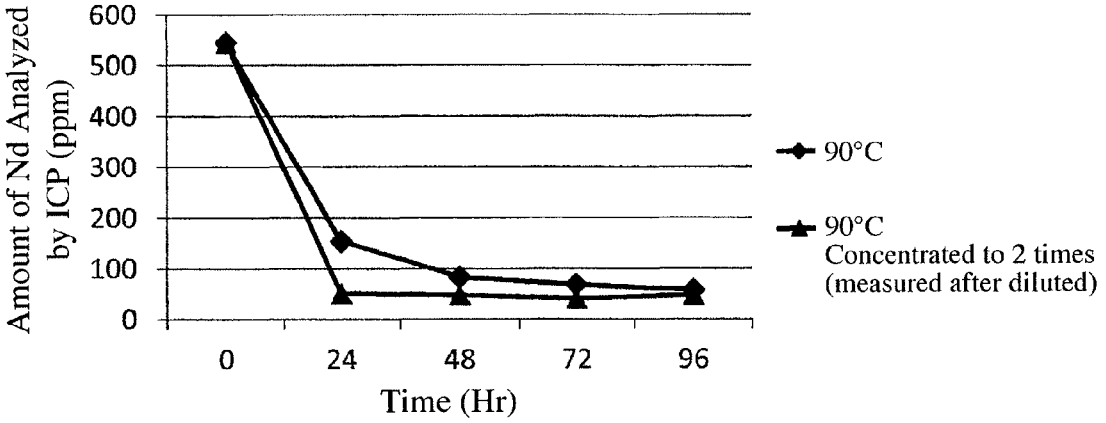
FIG. 5 is a graph showing the amount of Nd as a rare earth impurity in the filtered plating solution with the plating solution concentrated, which was analyzed by an ICP atomic emission spectrometer.

The plating solution was taken in a sufficient amount for ICP atomic emission spectrometry at constant intervals, to measure the concentration of Nd by ICP atomic emission spectrometer in the same manner as in Example 1. The analysis results are shown in Table 3 as well as in the graph of FIG. 5.

When water was added to keep the amount of the plating solution, the amount of the impurity decreased gradually, and reached 59 ppm in 96 hours. When the amount of the plating solution was not kept (water was not added), the amount of the plating solution became half after about 24 hours. When the amount of the solution became half, water was added to keep the amount of the solution half. When the amount of the plating solution was not kept in the analysis of Nd, the collected plating solution was diluted to 2 times to measure the concentration of the impurity. The amount of Nd, an impurity, was 52 ppm when 24 hours passed. This indicates that a higher concentration of the plating solution provides more effect of reducing rare earth impurities.

TABLE 3

| | 0 hrs | 24 hrs | 48 hrs | 72 hrs | 96 hrs |
|---|---|---|---|---|---|
| 90° C. | 544 | 154 | 84 | 69 | 59 |
| 90° C. (Concentrated 2 Times) | 544 | 52 | 49 | 42 | 48 |

Note:
The unit was ppm.

Example 6

The same plating solution containing rare earth impurities as in Example 5, in which the Nd impurity was 544 ppm when 0 hour passed (before heating), was prepared, and 3-liter portions thereof were introduced into five beakers. The same precipitate as used in Example 3 was added in an amount of 1 g/L to each of four beakers, and no precipitate was added to one beaker.

The plating solution in each beaker was stirred as in Example 1 while heating at 90° C. Water was not added until the amount of the solution became half (substantially half when heated for 24 hours), and water was added after the amount of the solution reached half, thereby keeping the plating solution at a concentration 2 times the initial one. While keeping the concentration, stirring was conducted as in Example 1. When the precipitate was not added, the concentration of Nd, an impurity, became 52 ppm when heated for 24 hours.

In four beakers to which the precipitate was added, the concentration of Nd, an impurity, was measured. The impurity concentration when heated for 24 hours was 32 ppm, 56 ppm, 52 ppm, and 61 ppm, respectively. When the precipitate was added at the 2-fold concentration, the amount of the impurity was reduced to the same level as when the precipitate was not added. Incidentally, the plating solution taken in a beaker was diluted to 2 times, and then measured with respect to the concentration of Nd.

Example 7

The same plating solution containing rare earth impurities as in Example 2, in which the concentration of Nd was 576 ppm, was prepared. 3 liters of the plating solution was introduced into a beaker as in Example 2, and heated at 90° C. without stirring. Water was added to avoid the concentration change of the plating solution, keeping the amount of the plating solution. The plating solution was taken at constant intervals to measure the amount of the impurity by an ICP atomic emission spectrometer as in Example 1. The concentration of Nd, an impurity, was reduced substantially similarly in Example 2 to 137 ppm when 24 hours passed, 73 ppm when 72 hours passed, and 63 ppm when 96 hours passed.

As described above, if the amount of a plating solution were about 3 liters, stirring would not have large influence. However, the amount of a plating solution in a usual plating bath is several tens to 100 times or more that amount, and when rare earth impurities are removed from a plating solution of several hundreds of liters or more, for example, it is considered that stirring is necessary to keep the solution temperature uniform.

Example 8

The same plating solution as in Example 1 was prepared to analyze impurities (Nd, Fe and Cu) by an ICP atomic emission spectrometer. As a result, Nd was 500 ppm, Fe was 19 ppm, and Cu was 3 ppm. The plating solution was heated under the same condition (90° C.) as in Example 1, and taken in a sufficient amount for ICP atomic emission spectrometry after 24 hours and 96 hours to measure the impurity concentration as in Example 1. As a result, Nd was 100 ppm, Fe was 3 ppm, and Cu was less than a detection limit when 24 hours passed. Also, Nd was 50 ppm, Fe was 1 ppm, and Cu was less than a detection limit when 96 hours passed. It was confirmed that the method of the present invention was able to reduce not only rare earth impurities but also Fe and Cu.

Example 9

A plating solution of pH 4.5 having a composition comprising 250 g/L of nickel sulfate, 50 g/L of nickel chloride, and 45 g/L of boric acid was heated to 50° C. to carry out nickel electroplating on sintered R—Fe—B magnets having the same composition range as in Example 1. The magnets used in one batch had the same composition. After plating for several days, analysis indicated that the Nd impurity in the nickel-electroplating solution was 581 ppm. The above plating solution was introduced into beakers each in an amount of 3 liters, and heated at 90° C. During heating, stirring was conducted by a magnet stirrer. During heating, water was supplied to keep the concentration of the plating solution constant, and the amount (concentration) of Nd in the plating solution was analyzed as in Example 1 when 1 hour, 3 hours, 6 hours, 12 hours, and 24 hours, respectively, passed.

Figure 6:
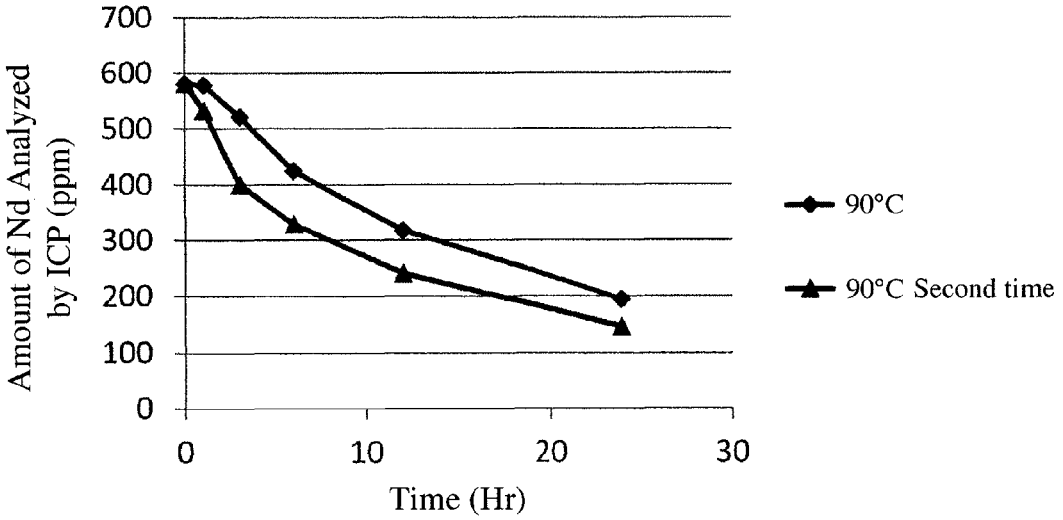
FIG. 6 is a graph showing the amount of Nd as a rare earth impurity in the filtered plating solution within 24 hours when heated at 90° C., which was analyzed by an ICP atomic emission spectrometer.

After 24 hours, the stirrer was stopped to sediment precipitate. After the precipitate was sedimented, the plating solution was taken out of the beaker, with the precipitate left on the beaker bottom. Next, the nickel-electroplating solution prepared in this Example, in which the concentration of Nd was 581 ppm, was introduced into the beaker in which the precipitate remained, and heated at 90° C. During heating, stirring was conducted by a magnet stirrer. During heating, water was supplied to keep the concentration of the plating solution constant, and the concentration of the rare earth impurity in the plating solution was measured as in Example 1 when 1 hour, 3 hours, 6 hours, 12 hours and 24 hours, respectively, passed. The analysis results are shown in Table 4 as well as in the graph of FIG. 6, together with the results before the precipitate was left.

TABLE 4

| | 0 hr | 1 hr | 3 hrs | 6 hrs | 12 hrs | 24 hrs |
|---|---|---|---|---|---|---|
| 90° C. | 581 | 578 | 521 | 425 | 318 | 195 |
| 90° C. (Second Times) | 581 | 532 | 400 | 329 | 241 | 146 |

Note:
The unit was ppm.

It was confirmed that when heated at 90° C., the concentration of Nd remarkably decreased after heating for about 3 hours. It was also confirmed that when the plating solution was treated in the beaker in which the precipitate remained (second time), the concentration of Nd decreased further rapidly. When the precipitate was left, the same results as in Example 4, in which the precipitate was added, was obtained.

Example 10

The same plating solution as in Example 9, in which the Nd was 581 ppm, was prepared, introduced in an amount of 3 liters into a beaker, and heated at 90° C. Water was not supplied until the concentration of the plating solution became 2 times (the amount of the solution became half) by heating, and when the amount of the solution reached half, water was supplied to keep the amount of the solution. When 1 hour, 3 hours, 6 hours, 12 hours and 24 hours, respectively, passed, the amount (concentration) of Nd in the plating solution was analyzed as in Example 1, with the plating solution diluted (2 times) such that its concentration became the same as before heating. After 24 hours, the stirrer was stopped to sediment precipitate. After the precipitate was sedimented, the plating solution was taken out of the beaker, with the precipitate left on the beaker bottom.

Figure 7:
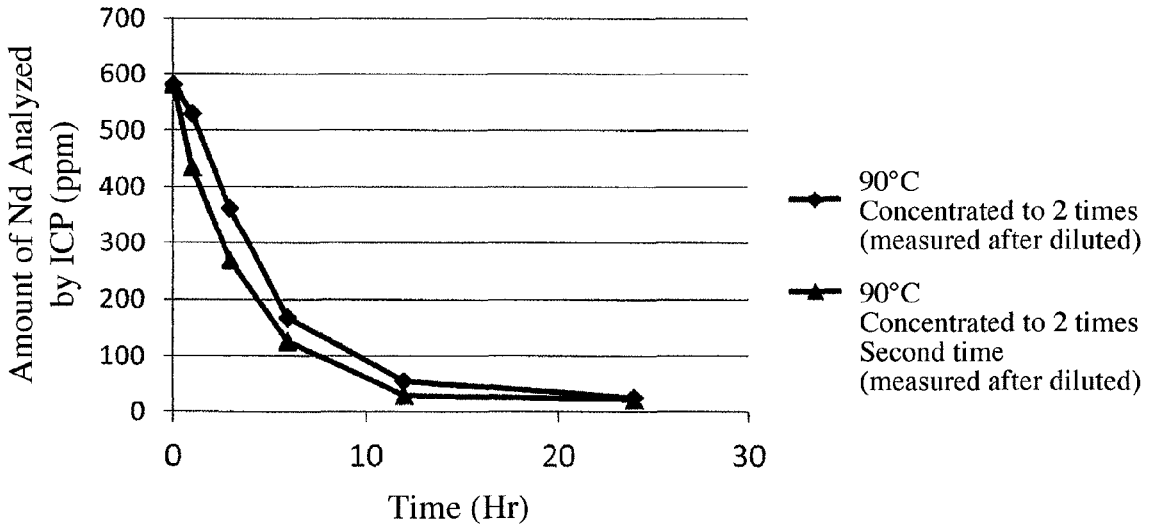
FIG. 7 is a graph showing the amount of Nd as a rare earth impurity in the filtered plating solution within 24 hours when the plating solution was concentrated by heating at 90° C., which was analyzed by an ICP atomic emission spectrometer.

Next, the same nickel-electroplating solution as in Example 9, in which the concentration of Nd was 581 ppm, was introduced into the beaker in which the precipitate remained, and heated at 90° C. Water was not added until the concentration of the plating solution became 2 times (the amount of the solution became half) by heating, and when the amount of the solution reached half, water was supplied to keep the amount of the solution. When 1 hour, 3 hours, 6 hours, 12 hours and 24 hours, respectively, passed, the concentration of Nd, an impurity, in the plating solution was analyzed as in Example 1, with the plating solution diluted (2 times) such that its concentration became the same as before heating. The analysis results are shown in Table 5 as well as in the graph of FIG. 7, together with the results before the precipitate was left.

TABLE 5

| | 0 hr | 1 hr | 3 hrs | 6 hrs | 12 hrs | 24 hrs |
|---|---|---|---|---|---|---|
| 90° C., Concentrated to 2 times | 581 | 529 | 362 | 168 | 55 | 25 |
| 90° C., Concentrated to 2 times (Second Time) | 581 | 435 | 269 | 127 | 29 | 22 |

Note:
The unit was ppm.

When the solution surface was not kept during heating, decrease in Nd was observed even when 1 hour passed. When the plating solution was treated in the beaker in which the precipitate remained (second time), it was confirmed that the amount of Nd decreased rapidly, before 24 hours passed. When the precipitate remained, the same results as in Example 4, in which the precipitate was added, were obtained.

Example 11

Sintered R—Fe—B magnets were electroplated with nickel in the plating apparatus shown in FIG. 1, and the composition of a plating solution in which rare earth impurities were accumulated was analyzed. The sintered R—Fe—B magnets had the same composition range as in Example 1, and several types of magnets having different compositions were combined. The composition of the plating solution after plating was 250 g/L of nickel sulfate, 45 g/L of nickel chloride, and 45 g/L of boric acid. The concentration of the Nd impurity was 600 ppm.

Observation with the naked eye confirmed that the appearance of the magnet plated by a barrel-type method with the Nd impurity concentration of about 600 ppm suffered double plating and 1% or less of peeling. All (500 L) of this nickel-electroplating solution was sent from the plating bath 1 to the preliminary bath 8. With the temperature of the sent plating solution kept at 90° C., stirring was conducted using a stirring blade 9. After 24 hours, the stirring blade 9 was stopped, and the heater 10 was turned off. With the valve 16 closed and the valves 11, 14 and 15 open, the pump 12 was then operated to return the plating solution to the plating bath 1 through the filter means 13. The concentration of Nd in the plating solution returned to the plating bath 1 was 50 ppm.

In Example above, the plating solution was returned from the preliminary bath 8 to the plating bath 1, while being filtered, with the valve 16 closed and the valves 11, 14 and 15 open. It is possible, however, that the pump 12 is first operated with the valve 15 closed and the valves 11, 14 and 16 open, to circulate the plating solution from the preliminary bath 8 to the filter means 13, and then to the preliminary bath 8, that the filter means 13 is exchanged to new one after the plating solution is filtered, and that the plating solution is then returned from the preliminary bath 8 to the plating bath 1, with the valve 16 closed and the valves 11, 14 and 15 open.

Example 12

Components in the plating solution returned to the plating bath 1 with the amounts of rare earth impurities reduced by the method of Example 11 were analyzed. As a result, it was found that there was substantially no composition change, with only 0.2% decrease in nickel metal. The composition of the plating solution was adjusted to the composition before the amounts of rare earth impurities were reduced. After pH adjusted to 4.5, a proper amount of a pit-preventing agent was added to the plating solution, which was heated to a temperature of 50° C., to electroplate sintered R—Fe—B magnets by a barrel-type method.

The evaluation of the appearance of the resultant plating layer revealed that the plating layer suffered no double plating and peeling due to insufficient adhesion, confirming that the method of the present invention can separate and remove Nd, an impurity, as precipitate, providing a nickel-electroplating solution with reduced amounts of rare earth impurities, which is fully usable in industrial mass production.

Referring to Examples above, the desired relation between heating temperature and time in the present invention will be explained. The results of Example 2 indicate that the plating solution filtered with the temperature kept at 60° C. or higher had a reduced amount of Nd, and that a higher heating temperature provides a larger effect of reducing the amount of Nd. The relation between the amount of Nd and the generation of double plating and peeling in the plating layer varies depending on plating conditions, but double plating and peeling do not occur when the amount of Nd, an impurity, is about 200 ppm.

For example, when the treatment for reducing the amounts of rare earth impurities is conducted to reduce the amount of Nd to 200 ppm or less, it may be conducted with temperatures and time described below. With a preliminary bath disposed in addition to the plating bath, an impurities-accumulated plating solution is sent thereto and held there for 1 week (168 hours) to remove impurities. As a result, the impurities are reduced to about 200 ppm at a heating temperature of 60° C. Substantially the same effects are obtained in 5 days (120 hours) at 70° C., 3 days (72 hours) at 80° C., and 24 hours (1 day) at 90° C. and 95° C.

Thus, the time necessary for reducing the amounts of impurities varies depending on the heating temperature of the plating solution. With 1 week as unit period for production, a plating solution kept at 60° C. for 168 hours and then filtered is sufficiently usable for plating, and heating at 70° C. for 5 days can reduce the amounts of impurities to permissible levels for plating. Likewise, heating at 80° C., 90° C. and 95° C. can reduce the amounts of impurities in the plating solution in a shorter period of time. The heating temperature and time can be selected depending on the existence of an apparatus capable of heating the plating solution to the above temperature, and a production schedule.

However, a longer heating time makes it necessary to have a larger number of preliminary baths for removing impurities from the plating solution. With an apparatus capable of heating the plating solution at 90° C. or higher, the amounts of impurities can desirably be reduced to 100 ppm or less in 24 hours, at most in 48 hours.

Example 9 indicates that when heated at 90° C., the precipitation of impurities starts after about 3 hours. Further, when precipitate obtained by a previous treatment is left (for example, when precipitate obtained by the previous step is added, or when a new nickel-electroplating solution is added to a bath in which the sedimented precipitate remains, in the method repeating the operation for removing rare earth impurities from a nickel-electroplating solution plural times), the precipitation of impurities starts even after 1 hour. This indicates that impurities can be removed by the filtration or sedimentation of precipitate.

Example 10 indicates that when the plating solution concentrated to 2 times by heating at 90° C., the amount of Nd, an impurity, can be reduced to about 50 ppm in 12 hours. When precipitate obtained by the previous step is left, it is reduced to 50 ppm or less in 12 hours. Thus, precipitation starts by heating for 1 hour, and the resultant precipitate can be removed by filtration or sedimentation, resulting in 200 ppm or less of impurities after 6 hours. With the amount of Nd, an impurity, reduced to 200 ppm or less in a short period of time, plating can be continued.

Further, a treatment for 3 hours can reduce 581 ppm to 362 ppm (to 269 ppm when precipitate obtained by the previous step is left). In the use of the plating solution with a Nd concentration of 362 ppm (269 ppm), plating can be conducted for a certain period of time, though the plating time is shorter than when a new plating solution is used or when the amount of impurity is reduced to 200 ppm or less. When concentration by heating is combined with the addition of precipitate obtained by the previous step, even a treatment for about 1 hour can reduce 581 ppm to 435 ppm, securing a certain period of plating time, though shorter than when the above 3-hour treatment is conducted.

Though Examples above have confirmed the reduction of the amounts of impurities of Nd, Pr and Dy, reduction is also possible for Tb and other rare earth impurities. Further, the method of the present invention can reduce the amounts of Fe and Cu as impurities in the plating solution.

EFFECTS OF THE INVENTION

According to the present invention, rare earth impurities can be removed from a nickel-electroplating solution relatively easily and efficiently, without using complicated processes and special agents. Accordingly, particularly sintered R—Fe—B magnets can be electroplated with nickel with stabilized quality and reduced cost.

The present invention, which can efficiently remove rare earth impurities, which would generate plating defects, from a plating solution, is industrially applicable to the plating process of rare earth magnets.

EXPLANATION OF SYMBOLS

1 Plating bath
2, 5, 6, 7, 11, 14, 15, 16 Valve
3, 12 Pump
4, 13 Filter means
8 Preliminary bath
9 Stirring blade
10 Heater
17 Plating bath
19, 21 Preliminary bath
18, 20, 22 Pump and filter means

What is claimed is:

1. A method for removing rare earth impurities from a nickel-electroplating solution, consisting essentially of the steps of keeping a nickel-electroplating solution containing rare earth impurities at a temperature of 60° C. or higher for a predetermined period of time such that some components in the nickel-electroplating solution are not precipitated, and then removing precipitate of the rare earth impurities generated by heating from said nickel-electroplating solution by sedimentation and/or filtration.

2. The method for removing rare earth impurities from a nickel-electroplating solution according to claim 1, wherein said nickel-electroplating solution is stirred during heating.

3. The method for removing rare earth impurities from a nickel-electroplating solution according to claim 2, wherein said stirring is conducted by air stirring, the rotation of a stirring blade or circulation by a pump.

4. A method for removing rare earth impurities from a nickel-electroplating solution, wherein the operation recited in claim 1 for removing rare earth impurities from a nickel-electroplating solution is repeated plural times, the heating of the nickel-electroplating solution being conducted with precipitate generated by the previous operation existing in the nickel-electroplating solution.

5. The method for removing rare earth impurities from a nickel-electroplating solution according to claim 1, wherein said nickel-electroplating solution is concentrated by heating.

6. The method for removing rare earth impurities from a nickel-electroplating solution according to claim 5, wherein said nickel-electroplating solution from which rare earth impurities are removed is up to 3 times as concentrated as a nickel-electroplating solution in which plating is conducted.

7. A method for producing a sintered rare earth magnet having a plating layer, consisting essentially of the steps of preparing a nickel-electroplating solution containing rare earth impurities, keeping said plating solution at 60° C. or higher for a predetermined period of time such that some components in the nickel-electroplating solution are not precipitated, removing precipitate of the rare earth impurities by sedimentation and/or filtration from said nickel-electroplating solution heated for a predetermined period of time, and electroplating the sintered rare earth magnet with nickel in said precipitate-removed nickel-electroplating solution.

* * * * *